US008741789B2

(12) United States Patent
Li et al.

(10) Patent No.: US 8,741,789 B2
(45) Date of Patent: Jun. 3, 2014

(54) FLAME RESISTANT TEXTILE MATERIALS PROVIDING PROTECTION FROM NEAR INFRARED RADIATION

(75) Inventors: Shulong Li, Spartanburg, SC (US); James D. Cliver, Roebuck, SC (US); J. Travis Greer, Chesnee, SC (US); Jack W. Spoon, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 345 days.

(21) Appl. No.: 13/103,122

(22) Filed: May 9, 2011

(65) Prior Publication Data

US 2011/0281097 A1 Nov. 17, 2011

Related U.S. Application Data

(60) Provisional application No. 61/333,745, filed on May 11, 2010.

(51) Int. Cl.
*B32B 5/02* (2006.01)
*B32B 27/04* (2006.01)

(52) U.S. Cl.
USPC ..... 442/136; 442/131; 442/141; 428/920; 428/921

(58) Field of Classification Search
USPC ..... 442/136, 141, 131
See application file for complete search history.

(56) References Cited

U.S. PATENT DOCUMENTS

| | | | | |
|---|---|---|---|---|
| 3,900,664 | A | 8/1975 | Miller | |
| 4,918,795 | A | 4/1990 | Dischler | |
| 5,033,143 | A | 7/1991 | Love, III | |
| 5,223,334 | A | 6/1993 | Green | |
| 5,892,476 | A * | 4/1999 | Gindrup et al. | 342/1 |
| 6,546,605 | B1 | 4/2003 | Emery et al. | |
| 7,713,891 | B1 * | 5/2010 | Li et al. | 442/136 |
| 7,741,233 | B2 * | 6/2010 | Sasser et al. | 442/136 |
| 2003/0157294 | A1 | 8/2003 | Green | |
| 2004/0138083 | A1 | 7/2004 | Kimbrell, Jr. et al. | |
| 2004/0248487 | A1 * | 12/2004 | Yasumitsu | 442/131 |
| 2008/0038973 | A1 | 2/2008 | Sasser et al. | |

FOREIGN PATENT DOCUMENTS

| | | | |
|---|---|---|---|
| EP | 0 688 898 | A1 | 12/1995 |
| JP | 2000-328441 | A | 11/2000 |

OTHER PUBLICATIONS

Database WPI, Week 200134 Thompson Scientific, London, GB; XP002653939, & JP 2000 328441 A (Seiren Co. Ltd) Nov. 28, 2000 Abstract.

* cited by examiner

*Primary Examiner* — Lynda Salvatore
(74) *Attorney, Agent, or Firm* — Robert M. Lanning

(57) ABSTRACT

A flame resistant textile material comprises a textile substrate, a flame retardant finish applied to the textile substrate, and an infrared-absorbing finish applied to the textile substrate.

20 Claims, No Drawings

FLAME RESISTANT TEXTILE MATERIALS PROVIDING PROTECTION FROM NEAR INFRARED RADIATION

CROSS-REFERENCE TO RELATED PATENT APPLICATIONS

This patent applications claims, pursuant to 35 U.S.C. §119(e)(1), priority to and the benefit of the filing date of U.S. patent application Ser. No. 61/333,745 filed on May 11, 2010, which application is hereby incorporated by reference in its entirety.

TECHNICAL FIELD OF THE INVENTION

This patent application relates to treated textile material that are flame resistant and provide protection from near infrared radiation, such as that emitted by electric arcs.

BACKGROUND

Flame resistant (FR) textiles (for example clothing and blankets) are used by electrical workers and electricians to provide protection from exposure to the thermal effects of an electric arc flash. The heat from an electric arc flash can be extremely intense and is accompanied by a shock wave due to the rapid heating of the air and gases in the vicinity of the arc flash.

Protective clothing systems called arc flash suits have been developed to protect workers at risk of exposure to arc flashes. Such suits are designed to provide protection for various levels of exposure. However, most garments available today become uncomfortable when worn for long periods of time.

Accordingly, there is a need for lighter weight textile materials that provide satisfactory flame resistance and protection from the radiation (e.g., infrared radiation) generated by electric arc and are suitable for use in making garments that are comfortable to wear.

BRIEF SUMMARY OF THE INVENTION

The invention generally provides a treated textile material comprising a textile substrate. The textile substrate comprises at least some cellulosic fibers. In order to provide protection from fire, the textile substrate can be treated with a flame retardant compound or finish. Also, in order to the provide protection from near infrared radiation (e.g., momentary high emissions of infrared radiation caused, for example, by electric arcs), one surface of the textile substrate (e.g., the side facing away from the wearer) can be designed to reflect an appreciable amount of infrared radiation in the wavelengths from 800 nm to 1,200 nm. The opposite surface of the textile substrate (e.g., the side facing the wearer) can be design to absorb an appreciable amount of infrared radiation at the wavelengths of 800 nm and 1,200 nm, which is characterized by having relatively low reflectance at these wavelengths.

Thus, in a first embodiment, the invention provides a treated textile material comprising a textile substrate having a first surface and a second surface opposite the first surface. The textile substrate comprises a plurality of fibers, and at least a portion of the fibers are cellulosic fibers. The treated textile material further comprises a first finish applied to at least the first surface of the textile substrate. The first finish comprises a phosphorous-containing compound. The phosphorous-containing compound comprises a plurality of pentavalent phosphine oxide groups having amide linking groups covalently bonded thereto, and at least a portion of the pentavalent phosphine oxide groups have three amide linking groups covalently bonded thereto. The treated textile material further comprises a second finish applied to the second surface of the textile substrate, and the second finish comprises an infrared-absorbing material and a binder. The first surface of the textile substrate exhibits an average reflectance of about 40% or greater in the wavelengths from 800 nm to 1,200 nm, and the second surface of the textile substrate exhibits a reflectance of about 30% or less at 800 nm and about 50% or less at 1,200 nm.

In a second embodiment, the invention provides a treated textile material comprising a textile substrate having a first surface and a second surface opposite the first surface. The textile substrate comprises a plurality of fibers, and at least a portion of the fibers are cellulosic fibers. The treated textile material further comprises a first finish applied to at least the first surface of the textile substrate. The first finish comprises a phosphorous-containing compound polymerized within at least a portion of the cellulosic fibers, the phosphorous-containing compound comprising amide linking groups, and the phosphorous-containing compound being a product produced by heat-curing and oxidizing a reaction mixture comprising a first chemical selected from the group consisting of tetrahydroxymethyl phosphonium salts, condensates of tetrahydroxymethyl phosphonium salts, and mixtures thereof; and a cross-linking agent. The cross-linking agent can be selected from the group consisting of urea, guanidines, guanyl urea, glycoluril, ammonia, ammonia-formaldehyde adducts, ammonia-acetaldehyde adducts, ammonia-butyraldehyde adducts, ammonia-chloral adducts, glucosamine, polyamines, glycidyl ethers, isocyanates, blocked isocyanates, and mixtures thereof. The treated textile material further comprises a second finish applied to the second surface of the textile substrate, and the second finish comprises an infrared-absorbing material and a binder. The first surface of the textile substrate exhibits an average reflectance of about 40% or greater in the wavelengths from 800 nm to 1,200 nm, and the second surface of the textile substrate exhibits a reflectance of about 30% or less at 800 nm and about 50% or less at 1,200 nm.

DETAILED DESCRIPTION OF THE INVENTION

As noted above, the invention provides flame resistant textile materials. As utilized herein, the term "flame resistant" refers to a material that burns slowly or is self-extinguishing after removal of an external source of ignition. The flame resistance of textile materials can be measured by any suitable test method, such as those described in National Fire Protection Association (NFPA) 701 entitled "Standard Methods of Fire Tests for Flame Propagation of Textiles and Films," ASTM D6413 entitled "Standard Test Method for Flame Resistance of Textiles (vertical test)", NFPA 2112 entitled "Standard on Flame Resistant Garments for Protection of Industrial Personnel Against Flash Fire", ASTM F1506 entitled "The Standard Performance Specification for Flame Resistant Textile Materials for Wearing Apparel for Use by Electrical Workers Exposed to Momentary Electric Arc and Related Thermal Hazards", and ASTM F1930 entitled "Standard Test Method for Evaluation of Flame Resistant Clothing for Protection Against Flash Fire Simulations Using an Instrumented Manikin."

The textile materials of the invention generally comprise fabrics formed from one or more pluralities or types of yarns. The textile materials can be formed from a single plurality or type of yarn (e.g., the fabric can be formed solely from yarns comprising a blend of cellulosic fibers and thermoplastic synthetic fibers, such as polyamide fibers), or the textile material can be formed from several pluralities or different types of yarns (e.g., the fabric can be formed from a first plurality of yarns comprising cellulosic fibers and polyamide fibers and a second plurality of yarns comprising an inherent flame resistant fiber).

The yarns used in making the textile materials of the invention can be any suitable type of yarn. For example, at least some of the yarns, such as the warp yarns of a woven textile material, can be spun yarns. In such embodiments, the spun yarns can be made from a single type of staple fiber (e.g., spun yarns formed solely from cellulose fibers or spun yarns formed solely from inherent flame resistant fibers), or the spun yarns can be made from a blend of two or more different types of staple fibers (e.g., spun yarns formed from a blend of cellulose fibers and thermoplastic synthetic staple fibers, such as polyamide fibers). Such spun yarns can be formed by any suitable spinning process, such as ring spinning, air-jet spinning, or open-end spinning. In certain embodiments, these yarns are spun using a ring spinning process (i.e., the yarns are ring spun yarns).

In certain embodiments, the textile material can be made from a combination of spun yarns and filament yarns. In the case of a woven textile material, the yarns can be arranged such that the spun yarns are disposed in a single direction within the textile material and the filament yarns are disposed in the direction perpendicular to the spun yarns. Alternatively, the yarns can be arranged in the fabric so that a combination of spun yarns and filament yarns are together disposed in either the warp and/or fill directions of the textile material. In such an arrangement, the spun yarns and filament yarns can be arranged in any suitable pattern, such as a pattern in which one filament yarn is followed by one, two, three, or four spun yarns. In such embodiments, this pattern of filament and spun yarns can be used in either the warp and/or fill directions of the textile material. If a repeating pattern of filament yarns and spun yarns is used in both the warp and fill directions, the pattern used in each direction can be the same or different. In one potentially preferred embodiment, the textile material is a woven material comprising spun yarns (e.g., spun yarns comprising a blend of cellulosic fibers and thermoplastic synthetic fibers, such as polyamide fibers) in the warp direction and a combination of filament yarns and spun yarns (e.g., spun yarns comprising cellulosic fibers) in the fill direction. In this embodiment, the ratio of filament yarns to spun yarns in the fill direction is preferably one to at least two (that is, at least two spun yarns are used for each filament yarn), more preferably one to at least three, although other ratios may be used.

The textile materials of the invention can be of any suitable construction. In other words, the yarns forming the textile material can be provided in any suitable patternwise arrangement producing a fabric. Preferably, the textile materials are provided in a woven construction, such as a plain weave, basket weave, twill weave, satin weave, or sateen weave. More preferably, the textile material is provided in a sateen weave, such as a sateen weave in which the yarns are provided in a pattern of four over and one under. A sateen weave construction produces a textile material that is thicker than those produced by other weaves, such as plain weaves and twill weaves, at the same weight. While not wishing to be bound to any particular theory, it is believed that this increased thickness may provide a wearer with increased protection from the high radiation flux generated, for example, by electric arcs.

The textile material of the invention can be constructed to have any suitable fabric weight. In certain possibly preferred embodiments, the textile material has a weight of about 16 oz/yd$^2$ or less, about 14 oz/yd$^2$ or less, about 12 oz/yd$^2$ or less, about 10 oz/yd$^2$ or less, about 9 oz/yd$^2$ or less, about 8 oz/yd$^2$ or less, or about 7 oz/yd$^2$ or less (e.g., about 6.5 oz/yd$^2$ or less). While the same FR performance can be achieved with higher weight fabrics, the high weight fabrics have a tendency to be heavy, have poor air permeability, and therefore are uncomfortable to wear for extended periods of time. The textile materials of the invention preferably have an air permeability of at least about 60 cfm, more preferably 100 cfm. These levels of air permeability have been shown to produce fabrics having good breathability.

The textile material of the invention can be constructed to have any suitable thickness. In certain possibly preferred embodiments, the flame resistant textile material fabric has a thickness of at least about 19.5 mils (approx. 0.5 mm) as received. "As received", in this application, means the fabric at the end of all processing conditions (including weaving, desizing/scouring, dyeing, FR treatment, finish application, mechanical treatment, etc.) and is the fabric in the finished roll or sewn goods. The flame resistant textile material can also have a thickness of at least about 25 mils (approx. 0.64 mm) after 3 standard home laundering cycles using water at 120° F. While not being bound to any theory, it is believed that these thicker textile materials are able to provide greater protection from infrared radiation.

As noted above, the textile materials of the invention contain yarns comprising cellulosic fibers. As utilized herein, the term "cellulosic fibers" is used to refer to fibers composed of, or derived from, cellulose. Examples of suitable cellulosic fibers include cotton, rayon, linen, jute, hemp, cellulose acetate, and combinations, mixtures, or blends thereof. Preferably, the cellulosic fibers comprise cotton fibers.

In those embodiments of the textile material comprising cotton fibers, the cotton fibers can be of any suitable variety. Generally, there are two varieties of cotton fibers that are readily available for commercial use in North America: the American Upland variety (*Gossypium hirsutum*) and the American Pima variety (*Gossypium barbadense*). The cotton fibers used as the cellulosic fibers in the invention can be cotton fibers of either the American Upland variety, the American Pima variety, or a combination, mixture, or blend of the two. Generally, cotton fibers of the American Upland variety, which comprise the majority of the cotton used in the apparel industry, have lengths ranging from about 0.875 inches to about 1.3 inches, while the less common fibers of the American Pima variety have lengths ranging from about 1.2 inches to about 1.6 inches. Preferably, at least some of the cotton fibers used in the invention are of the American Pima variety, which are preferred due to their greater, more uniform length.

In those embodiments in which the textile material comprises cellulosic fibers, the cellulosic fibers can be present in the yarns in any suitable amount. In certain embodiments, the cellulosic fibers can comprise about 100%, by weight, of the fibers present in one of the pluralities or types of yarn used in making the textile material. In other embodiments, the cellulosic fibers can comprise about 35% or more (e.g., about 50% or more), by weight, of the fibers present in one of the pluralities or types of yarn used in making the textile material. In some embodiments, the yarn can include non-cellulosic fibers. In such embodiments, the cellulosic fibers can comprise about 35% to about 100% (e.g., about 35% to about 90% or about 50% to about 90%), by weight, of the fibers present in one of the pluralities or types of yarn used in making the textile material. In such embodiments, the remainder of the yarn can be made up of any suitable non-cellulosic fiber or combination of non-cellulosic fibers, such as the thermoplastic synthetic fibers and inherent flame resistant fibers discussed below.

In those embodiments in which the textile material comprises cellulosic fibers, the cellulosic fibers can be present in the textile material in any suitable amount. For example, in certain embodiments, the cellulosic fibers can comprise about 15% or more, about 20% or more, about 25% or more, about 30% or more, or about 35% or more, about 40% or more, about 45% or more, about 50% or more, about 55% or more, about 60% or more, about 65% or more, about 70% or more, about 75% or more, about 80% or more, or about 85% or more, by weight, of the fibers present in the textile material. While the inclusion of cellulosic fibers can improve the comfort of the textile material (e.g., improve the hand and moisture absorbing characteristics), the use of only cellulosic fibers or the inclusion of a high amount of cellulosic fibers can deleteriously affect the durability of the textile material. Accordingly, it may be desirable to limit the amount of cellulosic fiber in the textile material in order to achieve a desired level of durability. Thus, in certain embodiments, the cellulosic fibers can comprise about 95% or less, about 90% or less, about 85% or less, or about 80% or less, by weight, of the fibers present in the textile material. More specifically, in certain embodiments, the cellulosic fibers can comprise about 15% to about 95%, or about 20% to about 90% (e.g., about 30% to about 90%, about 40% to about 90%, about 50% to about 90%, about 60% to about 90%, or about 70% to about 90%), by weight, of the fibers present in the textile material.

In certain embodiments of the invention, one or more of the yarns in the textile material can comprise thermoplastic synthetic fibers. These thermoplastic synthetic fibers include filaments and staple fibers. These thermoplastic synthetic fibers typically are included in the textile material in order to increase its durability to, for example, industrial washing conditions. In particular, thermoplastic synthetic fibers tend to be rather durable to abrasion and harsh washing conditions employed in industrial laundry facilities and their inclusion in, for example, a cellulosic fiber-containing spun yarn can increase that yarn's durability to such conditions. This increased durability of the yarn, in turn, leads to an increased durability for the textile material. Suitable thermoplastic synthetic fibers include, but are not necessarily limited to, polyester fibers (e.g., poly(ethylene terephthalate) fibers, poly (propylene terephthalate) fibers, poly(trimethylene terephthalate) fibers), poly(butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, and combinations, mixtures, or blends thereof.

In those embodiments in which the textile material comprises thermoplastic synthetic fibers, the thermoplastic synthetic fibers can be present in one of the pluralities or types of yarn used in making the textile material in any suitable amount. In certain preferred embodiments, the thermoplastic synthetic fibers comprise about 60% or less, about 50% or less, about 40% or less, about 30% or less, about 25% or less, about 20% or less, or about 15% or less, by weight, of the fibers present in one of the pluralities or types of yarn used in making the textile material. In certain preferred embodiments, the thermoplastic synthetic fibers comprise about 0% or more, about 5% or more, or about 10% or more, by weight, of the fibers present in one of the pluralities or types of yarn used in making the textile material. Thus, in certain preferred embodiments, the thermoplastic synthetic fibers comprise about 0% to about 65% (e.g., about 1% to about 65%), about 5% to about 60% (e.g., about 5% to about 50%, about 5% to about 40%, about 5% to about 30%, about 5% to about 25%, about 5% to about 20%, or about 5% to about 15%), or about 10% to about 50% (e.g., about 10% to about 40%, about 10% to about 30%, about 10% to about 25%, about 10% to about 20%, or about 10% to about 15%), by weight, of the fibers present in one of the pluralities or types of yarn used in making the textile material.

In those embodiments in which the textile material comprises thermoplastic synthetic fibers, the thermoplastic synthetic fibers can be present in the textile material in any suitable amount. For example, in certain embodiments, the thermoplastic synthetic fibers can comprise about 1% or more, about 2.5% or more, about 5% or more, about 7.5% or more, or about 10% or more, by weight, of the fibers present in the textile material. The thermoplastic synthetic fibers can comprise about 40% or less, about 35% or less, about 30% or less, about 25% or less, about 20% or less, or about 15% or less, by weight, of the fibers present in the textile material. More specifically, in certain embodiments, the thermoplastic synthetic fibers can comprise about 1% to about 40%, about 2.5% to about 35%, about 5% to about 30% (e.g., about 5% to about 25%, about 5% to about 20%, or about 5% to about 15%), or about 7.5% to about 25% (e.g., about 7.5% to about 20%, or about 7.5% to about 15%), by weight, of the fibers present in the textile material.

In one preferred embodiment, the textile material comprises a plurality of yarns comprising a blend of cellulosic fibers and synthetic fibers (e.g., synthetic staple fibers). In this embodiment, the synthetic fibers can be any of those described above, with polyamide fibers (e.g., polyamide staple fibers) being particularly preferred. In such an embodiment, the cellulosic fibers comprise about 50% to about 90% (e.g., about 60% to about 90%, about 65% to about 90%, about 70% to about 90%, or about 75% to about 90%), by weight, of the fibers present in the yarn, and the polyamide fibers comprise about 10% to about 50% (e.g., about 10% to about 40%, about 10% to about 35%, about 10% to about 30%, or about 10% to about 25%), by weight, of the fibers present in the yarn.

As noted above, certain embodiments of the textile materials of the invention can contain yarns comprising inherent flame resistant fibers. As utilized herein, the term "inherent flame resistant fibers" is used to refer to synthetic fibers which, due to the chemical composition of the material from which they are made, exhibit flame resistance without the need for an additional flame retardant treatment. In such embodiments, the inherent flame resistant fibers can be any suitable inherent flame resistant fibers, such as polyoxadiazole fibers, polysulfonamide fibers, poly(benzimidazole) fibers, poly(phenylenesulfide) fibers, meta-aramid fibers, para-aramid fibers, polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. In certain embodiments, the inherent flame resistant fibers are preferably selected from the group consisting of polyoxadiazole fibers, polysulfonamide fibers, poly(benzimidazole) fibers, poly(phenylenesulfide) fibers, meta-aramid fibers, para-aramid fibers, and combinations, mixtures, or blends thereof. In a more specific embodiment, the inherent flame resistant fibers can be selected from the group consisting of polyoxadiazole fibers, polysulfonamide fibers, poly(benzimidazole) fibers, poly(phenylenesulfide) fibers, and combinations, mixtures, or blends thereof.

As noted above, at least one of the surfaces of the textile material has been treated with one or more flame retardant treatments or finishes to render the textile materials more flame resistant. Typically, such flame retardant treatments or finishes are applied to a textile material containing cellulosic fibers in order to impart flame resistant properties to the cellulosic portion of the textile material. In such embodiments, the flame retardant treatment or finish can be any suitable treatment. Suitable treatments include, but are not limited to, halogenated flame retardants (e.g., brominated or chlorinated flame retardants), phosphorous-based flame retardants, antimony-based flame retardants, nitrogen-containing flame retardants, and combinations, mixtures, or blends thereof.

In one preferred embodiment, the textile material comprises cellulosic fibers and has been treated with a phosphorous-based flame retardant treatment. In this embodiment, a tetrahydroxymethyl phosphonium salt, a condensate of a tetrahydroxymethyl phosphonium salt, or a mixture thereof is first applied to the textile material. As utilized herein, the term "tetrahydroxymethyl phosphonium salt" refers to salts containing the tetrahydroxymethyl phosphonium (THP) cation, which has the structure

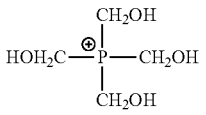

including, but not limited to, the chloride, sulfate, acetate, carbonate, borate, and phosphate salts. As utilized herein, the term "condensate of a tetrahydroxymethyl phosphonium salt" (THP condensate) refers to the product obtained by reacting a tetrahydroxymethyl phosphonium salt, such as those described above, with a limited amount of a cross-linking agent, such as urea, guanazole, or biguanide, to produce a compound in which at least some of the individual tetrahydroxymethyl phosphonium cations have been linked through their hydroxymethyl groups. The structure for such a condensate produced using urea is set forth below

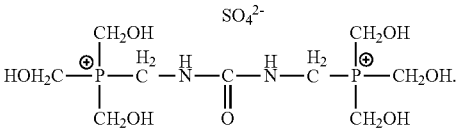

The synthesis of such condensates is described, for example, in Frank et al. (*Textile Research Journal*, November 1982, pages 678-693) and Frank et al. (*Textile Research Journal*, December 1982, pages 738-750). These THPS condensates are also commercially available, for example, as PYROSAN® CFR from Emerald Performance Materials.

The THP or THP condensate can be applied to the textile material in any suitable amount. Typically, the THP salt or THP condensate is applied to the textile material in an amount that provides at least 0.5% (e.g., at least 1%, at least 1.5%, at least 2%, at least 2.5%, at least 3%, at least 3.5%, at least 4%, or at least 4.5%) of elemental phosphorus based on the weight of the untreated textile material. The THP salt or THP condensate is also typically applied to the textile in an amount that provides less than 5% (e.g., less than 4.5%, less than 4%, less than 3.5%, less than 3%, less than 2.5%, less than 2%, less than 1.5%, or less than 1%) of elemental phosphorus based on the weight of the untreated textile material. Preferably, the THP salt or THP condensate is applied to the textile material in an amount that provides about 1% to about 4% (e.g., about 1% to about 3% or about 1% to about 2%) of elemental phosphorous based on the weight of the untreated textile material.

Once the THP salt or THP condensate has been applied to the textile material, the THP salt or THP condensate is then reacted with a cross-linking agent. The product produced by this reaction is a cross-linked phosphorus-containing flame retardant polymer. The cross-linking agent is any suitable compound that enables the cross-linking and/or curing of THP. Suitable cross-linking agents include, for example, urea, a guanidine (i.e., guanidine, a salt thereof, or a guanidine derivative), guanyl urea, glycoluril, ammonia, an ammonia-formaldehyde adduct, an ammonia-acetaldehyde adduct, an ammonia-butyraldehyde adduct, an ammonia-chloral adduct, glucosamine, a polyamine (e.g., polyethyleneimine, polyvinylamine, polyetherimine, polyethyleneamine, polyacrylamide, chitosan, aminopolysaccharides), glycidyl ethers, isocyanates, blocked isocyanates and combinations thereof. Preferably, the cross-linking agent is urea or ammonia, with urea being the more preferred cross-linking agent.

The cross-linking agent can be applied to the textile material in any suitable amount. The suitable amount of cross-linking agent varies based on the weight of the textile material and its construction. Typically, the cross-linking agent is applied to the textile material in an amount of at least 0.1% (e.g., at least 1%, at least 2%, at least 3%, at least 5%, at least 7%, at least 10%, at least 15%, at least 18%, or at least 20%) based on the weight of the untreated textile material. The cross-linking agent is also typically applied to the textile material in an amount of less than 25% (e.g., less than 20%, less than 18%, less than 15%, less than 10%, less than 7%, less than 5%, less than 3%, or less than 1%) based on the weight of the untreated textile material. In a potentially preferred embodiment, the cross-linking agent is applied to the textile material in an amount of about 2% to about 7% based on the weight of the untreated textile material.

In order to accelerate the condensation reaction of the THP salt or THP condensate and the cross-linking agent, the above-described reaction can be carried out at elevated temperatures. The time and elevated temperatures used in this curing step can be any suitable combinations of times and temperatures that result in the reaction of the THP or THP condensate and cross-linking agent to the desired degree. The time and elevated temperatures used in this curing step can also promote the formation of covalent bonds between the cellulosic fibers and the phosphorous-containing condensation product, which is believed to contribute the durability of the flame retardant treatment. However, care must be taken not to use excessively high temperatures or excessively long cure times that might result in excessive reaction of the flame retardant with the cellulosic fibers, which might weaken the cellulosic fibers and the textile material. Furthermore, it is believed that the elevated temperatures used in the curing step can allow the THP salt or THP condensate and cross-linking agent to diffuse into the cellulose fibers where they react to form a cross-linked phosphorus-containing flame retardant polymer within the fibers. Suitable temperatures and times for this curing step will vary depending upon the curing oven used and the speed with which heat is transferred to the textile material, but suitable conditions can range from temperatures of about 149° C. (300° F.) to about 177° C. (350° F.) and times from about 1 minute to about 3 minutes.

In the case where ammonia is used as the cross-linking agent, it is not necessary to use elevated temperatures for the THP salt or THP condensate and cross-linking agent to react. In such case, the reaction can be carried out, for example, in a gas-phase ammonia chamber at ambient temperature. A suitable process for generating a phosphorous-based flame retardant using this ammonia-based process is described, for example, in U.S. Pat. No. 3,900,664 (Miller), the disclosure of which is hereby incorporated by reference.

After the THP salt or THP condensate and cross-linking agent have been cured and allowed to react to the desired degree, the resulting textile material can be exposed to an oxidizing agent. While not wishing to be bound to any particular theory, it is believed that this oxidizing step converts the phosphorous in the condensation product (i.e., the condensation product produced by the reaction of the THP salt or THP condensate and cross-linking agent) from a trivalent form to a more stable pentavalent form. The resulting phosphorous-containing compound (i.e., cross-linked, phosphorous-containing flame retardant polymer) is believed to contain a plurality of pentavalent phosphine oxide groups. In those embodiments in which urea has been used to cross-link the THP salt or THP condensate, the phosphorous-containing compound comprises amide linking groups covalently bonded to the pentavalent phosphine oxide groups, and it is believed that at least a portion of the phosphine oxide groups have three amide linking groups covalently bonded thereto.

The oxidizing agent used in this step can be any suitable oxidant, such as hydrogen peroxide, sodium perborate, or sodium hypochlorite. The amount of oxidant can vary depending on the actual materials used, but typically the oxidizing agent is incorporated in a solution containing at least 0.1% concentration (e.g., at least 0.5%, at least 0.8, at least 1%, at least 2%, or at least 3% concentration) and less than 20% concentration (e.g., less than 15%, less than 12%, less than 10%, less than 3%, less than 2%, or less than 1% concentration) of the oxidant.

After contacting the treated textile material with the oxidizing agent, the cured textile material preferably is contacted with a neutralizing solution (e.g., a caustic solution with a pH of at least 8, at least pH 9, at least pH 10, at least pH 11, or at least pH 12). The actual components of the caustic solution can widely vary, but suitable components include any strong base, such as alkalis. For example, sodium hydroxide (soda), potassium hydroxide (potash), calcium oxide (lime), or any combination thereof can be used in the neutralizing solution. The amount of base depends on the size of the bath and is determined by the ultimately desired pH level. A suitable amount of caustic in the solution is at least 0.1% concentration (e.g., at least 0.5%, at least 0.8, at least 1%, at least 2%, or at least 3% concentration) and is less than 10% concentration (e.g., less than 8%, less than 6%, less than 5%, less than 3%, less than 2%, or less than 1% concentration). The contact time of the treated textile material with the caustic solution varies, but typically is at least 30 seconds (e.g., at least 1 min, at least 3 min, at least 5 min, or at least 10 min). If desired, the neutralizing solution can be warmed (e.g., up to 75° C., up to 70° C., up to 60° C., up to 50° C., up to 40° C., up to 30° C. relative to room temperature).

Fabrics treated with THP-based flame retardants as described above can contain formaldehyde that is released under certain conditions. Accordingly, a textile material of the invention that has been treated with a THP-based flame retardant can be treated in a bath containing a reducing agent, which reduces the amount of releasable formaldehyde on the fabric. Suitable reducing agents include organic or inorganic compounds that react with formaldehyde at temperatures from about 20° C. to about 80° C. Examples of suitable reducing agents include, but are not limited to, sulfite salts, bisulfite salts (including sodium bisulfite and ammonium bisulfite), thiosulfate salts, urea compounds (including urea, thiourea, ethylene urea, and hydroxyethylene urea), guanazole, melamine, dicyanoamide, biuril, carbodihydrazide, diethylene glycol, phenols, thiophenols, hindered amines, and the like. The bath can contain any suitable amount of the reducing agent, but typically contains about 0.5% to about 20%, preferably about 0.5% to about 5%, by weight.

The textile material can be treated with the reducing agent by any suitable process. However, it has been found that conveying the textile material through a pad and nip roll is quite effective for treating the textile material with the reducing agent. Preferably, the temperature of the reducing agent bath is from about 20° C. (68° F.) to about 80° C. (176° F.), the exposure time of the textile material to the bath is about 20 to about 60 seconds, and the nip roll pressure is from about 15 psi to about 60 psi. After the textile material has been treated with the reducing agent, the textile material can be rinsed to remove excess reducing agent. However, it has been found that omitting the rinsing step, which results in some residual reducing agent on the textile material, can further reduce the level of releasable formaldehyde on the textile material.

As an alternative to or in addition to the reducing agent treatment described above, a textile material of the invention that has been treated with a THP-based flame retardant as described above can be further treated with a formaldehyde scavenger. Although a very large number of possible formaldehyde scavengers are reported in the literature, many of the known formaldehyde scavengers are not effective in reducing releasable formaldehyde on the flame resistant textile materials described herein. However, hydrazides have been found to have an unexpected dramatic effect in reducing the releasable formaldehyde level to less than about 100 ppm. Any suitable hydrazide compound can be used, including aliphatic and aromatic hydrazides. Specific examples of suitable hydrazides include, but are not limited to, carbohydrazide, semicarbohydrazide, adipic hydrazide, oxalic hydrazide, maleic hydrazide, halo-substituted benzoic hydrazide, benzhydrazide, hydroxybenzoic hydrazide, dihydroxybenzoic hydrazide, aminobenzoic hydrazide, alkyl substituted benzoic hydrazide, acethydrazide, caprylic hydrazide, decanoic hydrazide, hexanoic hydrazide, malonic hydrazide, formic hydrazide, oxamic acid hydrazide, toluenesulfonyl hydrazide, propionic acid hydrazide, salicyloyl hydrazide, and thiosemicarbohydrazide. The hydrazide compound can be applied to the textile material in any suitable amount, but typically is applied in an amount of about 0.2% to about 6%, 0.5% to about 3%, or about 1 to about 2%, by weight, based on the weight of the untreated textile material. The hydrazide compound typically is applied to the textile material in the form of a solution. After the solution containing the hydrazide compound is applied, the textile material is dried to remove the solvent and leave the hydrazide compound deposited on the textile material. It is believed that excessive temperatures can reduce the effectiveness of the hydrazide treatment. Accordingly, after the hydrazide compound is applied, the textile material typically is dried under conditions such that the textile material does not reach temperatures above 300° F. for more than ten seconds. Preferably, in such a drying step, the textile material is heated to a temperature of about 160° F. to about 290° F. or about 180° F. to about 250° F.

In order to provide protection against near infrared radiation, one surface of the textile material of the invention (e.g., the surface of the textile material that faces away from the wearer) is designed to exhibit an appreciable reflectance of radiation in the near infrared wavelengths (e.g., about 800 nm to about 1,200 nm). Typically, this surface of the textile material is designed to exhibit an average reflectance of about 40% or greater in the wavelengths from 800 nm to 1,200 nm. In certain possibly preferred embodiments, this surface of the textile material exhibits an average reflectance of about 45% or more, about 50% or more, about 55% or more, or about 60% or more in the wavelengths from 800 nm to 1,200 nm.

Any suitable means can be used to provide a surface exhibiting the average reflectance specified above. The textile material can be constructed from yarns containing a fiber or blend of fibers which exhibits the specified average reflectance. For example, it is believed that a textile material constructed from yarns containing an intimate blend of 88% cotton and 12% nylon 6,6 will exhibit an average reflectance of about 40% or more (e.g., about 50% or more). In addition to the choice of fiber, the textile material can be dyed to yield the desired infrared reflectance properties. Any suitable dye or pigment can be used, provided it produces a textile material exhibiting the recited reflectance properties when it is applied to the textile material. As will be understood by those of ordinary skill in the art, the choice of dye or pigment suitable for this purpose will be driven by many factors, including the fiber content of the textile material, and the desired visual shade for the fabric. Suitable dyes and pigments include, but are not limited to, perylene red, pigment black 31, pigment black 32, pigment violet 14, pigment violet 16, and titanium dioxide.

In order to further enhance the protection against near infrared radiation, one surface of the textile material of the invention (e.g., the surface of the textile material that faces the wearer) is designed to exhibit a relatively low reflectance of radiation in the near infrared wavelengths (e.g., about 800 nm to about 1,200 nm). Due to this relatively low infrared reflectance, this surface of the textile material actually exhibits an appreciable absorbance of near infrared radiation. While not wishing to be bound to any particular theory, it is believed that a surface which exhibits a relatively low reflectance and an appreciable absorbance of near infrared radiation will serve as a barrier that prevents the transmission of infrared radiation through the textile material and to the wearer's skin, where it can cause burns. More specifically, it is believed that this combination of an infrared reflecting surface and an infrared absorbing surface helps to minimize the amount of infrared radiation that passes through the textile material, where it can contact the skin of the wearer and cause burns. Typically, this surface of the textile material is designed to exhibit an infrared reflectance of about 30% or less at a wavelength of 800 nm and about 50% or less at a wavelength of 1,200 nm. In certain possibly preferred embodiments, this surface of the textile exhibits an infrared reflectance of about 25% or less or about 20% or less at a wavelength of 800 nm and about 45% or less, about 40% or less, about 35% or less, about 30% or less, about 25% or less, or about 20% or less at a wavelength of 1,200 nm.

Any suitable means can be used to provide a second surface of the textile material with the relatively low near infrared reflectance properties described above. Typically, in order to enable the production of a textile material in which opposite surfaces exhibit substantially different infrared reflectance properties, this second surface of the textile material is finished with a treatment comprising an infrared-absorbing material and a binder. The binder is included in the treatment so that the finish is durable to abrasion and washing.

The infrared-absorbing material included in the finish can be any suitable infrared-absorbing material. Preferably, the infrared-absorbing material exhibits a relatively low reflectance and a concomitantly appreciable absorbance of infrared radiation having wavelengths of from about 800 nm to about 1,200 nm. As will be understood by those of ordinary skill in the art, suitable infrared-absorbing materials need not exhibit their maximum absorption within this wavelength range to be suitable for use in the invention. The infrared-absorbing materials need only exhibit sufficient absorbance within this range such that they can be applied to the textile material to produce a material exhibiting the desired infrared reflectance properties. In certain possibly preferred embodiments, the infrared-absorbing material is selected from the group consisting of carbon black, graphite, anthraquinone black, aniline black, vat black 8, vat black 16, vat black 20, vat black 25, vat blue 8, vat blue 19, vat blue 43, vat green 1, phthalocyanines, perylene diimides, terrylene diimides, quaterrylene diimides, and mixtures thereof.

The binder included in the infrared-absorbing finish can be any suitable binder. Naturally, binders which are adapted for use on textile materials are particularly suitable. Suitable binders include, but are not limited to, latex binders, polyurethane binders, and mixtures thereof.

If desired, the textile material can be treated with one or more softening agents (also known as "softeners") to improve the hand of the treated textile material. The softening agent selected for this purpose should not have a deleterious effect on the flammability of the resultant fabric. Suitable softeners include polyolefins, ethoxylated alcohols, ethoxylated ester oils, alkyl glycerides, alkylamines, quaternary alkylamines, halogenated waxes, halogenated esters, silicone compounds, and mixtures thereof. Preferably, the softening agent is a cationic softening agent, such as polyolefins, modified polyolefins, ethoxylated alcohols, ethoxylated ester oils, alkyl glycerides, fatty acid derivatives, fatty imidazolines, paraffins, halogenated waxes, halogenated esters, and mixtures thereof.

In addition to softening agents, other textile finishing compounds may be used to treat the textile material of the invention. These textile finishing compounds can be applied in separate steps or can be added to one or more of the baths used to treat the textile material of the invention as described above. Suitable textile finishing compounds include, but are not limited to, wetting agents, surfactants, stain release agents, soil repel agents, antimicrobial compounds, wicking agents, anti-static agents, antimicrobials, antifungals, and the like. Advantageously, chemicals that require, or benefit from, heat-setting or curing at high temperatures may be successfully incorporated into the flame retardant bath chemistry. As yet another alternative, as will be described further herein, soil repellent chemistry may be applied after the application of the flame retardant chemistry.

One potentially preferred combination of chemistries for imparting wash durable stain resistance and stain release is described in US Patent Application Publication No. 2004/0138083 to Kimbrell et al., the contents of which are hereby incorporated by reference. Briefly, the compositions useful for rendering a substrate with durable stain resistance and stain release are typically comprised of a hydrophilic stain release agent, a hydrophobic stain repellency agent, a hydrophobic cross-linking agent, and optionally, other additives to impart various desirable attributes to the substrate. In this publication, new chemical compositions are contemplated wherein the relative amount and chain length of each of the aforementioned chemical agents may be optimized to achieve the desired level of performance for different target substrates within a single chemical composition.

Hydrophilic stain release agents may include ethoxylated polyesters, sulfonated polyesters, ethoxylated nylons, carboxylated acrylics, cellulose ethers or esters, hydrolyzed polymaleic anhydride polymers, polyvinylalcohol polymers, polyacrylamide polymers, hydrophilic fluorinated stain release polymers, ethoxylated silicone polymers, polyoxyethylene polymers, polyoxyethylene-polyoxypropylene copolymers, and the like, or combinations thereof. Hydrophilic fluorinated stain release polymers may be preferred stain release agents. Potentially preferred, non-limiting, compounds of this type include UNIDYNE® TG-992 and UNIDYNE® S-2003, both available from Daikin Corporation; REPEARL® SR1100, available from Mitsubishi Corporation; ZONYL® 7910, available from DuPont; and NUVA® 4118 (liquid) from Clariant. Treatment of a substrate with a hydrophilic stain release agent generally results in a surface that exhibits a high surface energy.

Hydrophobic stain repellency agents include waxes, silicones, certain hydrophobic resins, fluoropolymers, and the like, or combinations thereof. Fluoropolymers may be preferred stain repellency agents. Potentially preferred, non-limiting, compounds of this type include REPEARL® F8025 and REPEARL® F-89, both available from Mitsubishi Corp.; ZONYL® 7713, available from DuPont; E061, available from Asahi Glass; NUVA® N2114 (liquid), available from Clariant; and UNIDYNE® S-2000, UNIDYNE® S-2001, UNIDYNE® S-2002, all of which are available from Daikin Corporation. Treatment of a substrate with a hydrophobic stain repellency agent generally results in a surface that exhibits a low surface energy.

Hydrophobic cross-linking agents include those cross-linking agents which are insoluble in water. More specifically, hydrophobic cross-linking agents may include monomers containing blocked isocyanates (such as blocked diisocyanates), polymers containing blocked isocyanates (such as blocked diisocyanates), epoxy containing compounds, and the like, or combinations thereof. Diisocyanate containing monomers or diisocyanate containing polymers may be the preferred cross-linking agents. However, monomers or polymers containing two or more blocked isocyanate compounds may be the most preferred cross-linking agents. One potentially preferred cross-linking agent is REPEARL® MF, also available from Mitsubishi Corp. Others include ARKOPHOB® DAN, available from Clariant, EPI-REZ® 5003 W55, available from Shell, and HYDROPHOBOL® XAN, available from DuPont.

The total amount of the repel/release composition applied to a substrate, as well as the proportions of each of the chemical agents comprising the repel/release composition, may vary over a wide range. The total amount of repel/release composition applied to a substrate will depend generally on the composition of the substrate, the level of durability required for a given end-use application, and the cost of the repel/release composition. Furthermore, the proportion of stain release agent to stain repellency agent to cross-linking agent may be varied based on the relative importance of each property being modified. For example, higher levels of repellency may be required for a given end-use application. As a result, the amount of repellency agent, relative to the amount of stain release agent, may be increased. Alternatively, higher levels of stain release may be deemed more important than high levels of stain repellency. In this instance, the amount of stain release agent may be increased, relative to the amount of stain repellency agent. As a general guideline, the total amount of solids applied to the substrate will be from about 10% to about 40% on weight of the substrate. More preferably, the total amount of solids applied to the substrate can be about 20% to about 35% on weight of the substrate. Typical solids proportions and concentration ratios of stain repellency agent to stain release agent to cross-linking agent can be from about 10:1:0 to about 1:10:5, including all proportions and ratios that found within this range. Preferably, solids proportions and concentration ratios of stain repellency agent to stain release agent to cross-linking agent are from about 5:1:0 to about 1:5:2. Most preferably, solids proportions and concentration ratios of stain repellency agent to stain release agent to cross-linking agent are 1:2:1.

Optionally, in addition to, or in place of, the stain release and/or stain repellency agents described above, halogenated lattices may be added to the flame retardant bath to further enhance the durability of the flame retardant finish. The term "halogenated lattices" refers to homopolymers and copolymers of polyvinyl chloride, polyvinylidene chloride, brominated polystyrene, chlorinated olefins, polychloroprenes, and the like. In some instances, it may be desirable to separately apply the stain release agent and the soil repellent agent.

To further enhance the textile material's hand, the textile material can optionally be treated using one or more mechanical surface treatments. A mechanical surface treatment typically relaxes stress imparted to the fabric during curing and fabric handling, breaks up yarn bundles stiffened during curing, and increases the tear strength of the treated fabric. Examples of suitable mechanical surface treatments include treatment with high-pressure streams of air or water (such as those described in U.S. Pat. Nos. 4,918,795, 5,033,143, and 6,546,605), treatment with steam jets, needling, particle bombardment, ice-blasting, tumbling, stone-washing, constricting through a jet orifice, and treatment with mechanical vibration, sharp bending, shear, or compression. A sanforizing process may be used instead of, or in addition to, one or more of the above processes to improve the fabric's hand and to control the fabric's shrinkage. Additional mechanical treatments that may be used to impart softness to the treated fabric, and which may also be followed by a sanforizing process, include napping, napping with diamond-coated napping wire, gritless sanding, patterned sanding against an embossed surface, shot-peening, sand-blasting, brushing, impregnated brush rolls, ultrasonic agitation, sueding, engraved or patterned roll abrasion, and impacting against or with another material, such as the same or a different fabric, abrasive substrates, steel wool, diamond grit rolls, tungsten carbide rolls, etched or scarred rolls, or sandpaper rolls.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A treated textile material comprising:

(a) a textile substrate having a first surface and a second surface opposite the first surface, the textile substrate comprising a plurality of fibers, at least a portion of the fibers being cellulosic fibers, (b) a first finish applied to at least the first surface of the textile substrate, the first finish comprising a phosphorous-containing compound, the phosphorous-containing compound comprising a plurality of pentavalent phosphine oxide groups having amide linking groups covalently bonded thereto, at least a portion of the pentavalent phosphine oxide groups having three amide linking groups covalently bonded thereto; and (c) a second finish applied to the second surface of the textile substrate, the second finish comprising an infrared-absorbing material and a binder;

wherein the first surface of the textile substrate exhibits an average reflectance of about 40% or greater in the wavelengths from 800 nm to 1,200 nm, and the second surface of the textile substrate exhibits a reflectance of about 30% or less at 800 nm and about 50% or less at 1,200 nm.

2. The treated textile material of claim 1, wherein the textile substrate further comprises synthetic fibers, and the cellulosic fibers comprise about 50% or more, by weight, of the fibers present in the textile substrate.

3. The treated textile material of claim 2, wherein the synthetic fibers are thermoplastic fibers selected from the group consisting of polyesters, polyamides, polyphenylsulfide, and mixtures thereof.

4. The treated textile material of claim 1, wherein the textile substrate is constructed from a plurality of yarns, and at least a portion of the yarns comprise a blend of cellulosic fibers and synthetic fibers.

5. The treated textile material of claim 1, wherein the textile substrate is a woven fabric comprising a plurality of warp yarns disposed in a first direction and a plurality of fill yarns disposed in a second direction substantially perpendicular to the first direction, and the warp and fill yarns are disposed in a sateen weave.

6. The treated textile material of claim 5, wherein the warp yarns and fill yarns comprise a blend of cellulosic fibers and polyamide fibers.

7. The treated textile material of claim 6, wherein the polyamide fibers comprise nylon 6,6 fibers.

8. The treated textile material of claim 1, wherein the treated textile material exhibits a weight of less than about 10 ounces per square yard.

9. The treated textile material of claim 1, wherein at least a portion of the phosphorous-containing compound is polymerized within at least a portion of the cellulosic fibers.

10. The treated textile material of claim 1, wherein the infrared-absorbing material is selected from the group consisting of carbon black, graphite, anthraquinone black, aniline black, vat black 8, vat black 16, vat black 20, vat black 25, vat blue 8, vat blue 19, vat blue 43, vat green 1, phthalocyanines, perylene diimides, terrylene diimides, quaterrylene diimides, and mixtures thereof.

11. A treated textile material comprising:

(a) a textile substrate having a first surface and a second surface opposite the first surface, the textile substrate comprising a plurality of fibers, at least a portion of the fibers being cellulosic fibers, (b) a first finish applied to at least the first surface of the textile substrate, the first finish comprising a phosphorous-containing compound polymerized within at least a portion of the cellulosic fibers, and the phosphorous-containing compound being a product produced by heat-curing and oxidizing a reaction mixture comprising:

(i) a first chemical selected from the group consisting of tetrahydroxymethyl phosphonium salts, condensates of tetrahydroxymethyl phosphonium salts, and mixtures thereof; and (ii) a cross-linking agent selected from the group consisting of urea, guanidines, guanyl urea, glycoluril, ammonia, ammonia-formaldehyde adducts, ammonia-acetaldehyde adducts, ammonia-butyraldehyde adducts, ammonia-chloral adducts, glucosamine, polyamines, glycidyl ethers, isocyanates, blocked isocyanates, and mixtures thereof; and (c) a second finish applied to the second surface of the textile substrate, the second finish comprising an infrared-absorbing material and a binder;

wherein the first surface of the textile substrate exhibits an average reflectance of about 40% or greater in the wavelengths from 800 nm to 1,200 nm, and the second surface of the textile substrate exhibits a reflectance of about 30% or less at 800 nm and about 50% or less at 1,200 nm.

12. The treated textile material of claim 11, wherein the textile substrate further comprises synthetic fibers, and the cellulosic fibers comprise about 50% or more, by weight, of the fibers present in the textile substrate.

13. The treated textile material of claim 12, wherein the synthetic fibers are thermoplastic fibers selected from the group consisting of polyesters, polyamides, polyphenylsulfide, and mixtures thereof.

14. The treated textile material of claim 11, wherein the textile substrate is constructed from a plurality of yarns, and at least a portion of the yarns comprise a blend of cellulosic fibers and synthetic fibers.

15. The treated textile material of claim 11, wherein the textile substrate is a woven fabric comprising a plurality of warp yarns disposed in a first direction and a plurality of fill yarns disposed in a second direction substantially perpendicular to the first direction, and the warp and fill yarns are disposed in a sateen weave.

16. The treated textile material of claim 15, wherein the warp yarns and fill yarns comprise a blend of cellulosic fibers and polyamide fibers.

17. The treated textile material of claim 16, wherein the polyamide fibers comprise nylon 6,6 fibers.

18. The treated textile material of claim 11, wherein the treated textile material exhibits a weight of less than about 10 ounces per square yard.

19. The treated textile material of claim 11, wherein at least a portion of the phosphorous-containing compound is polymerized within at least a portion of the cellulosic fibers.

20. The treated textile material of claim 11, wherein the infrared-absorbing material is selected from the group consisting of carbon black, graphite, anthraquinone black, aniline black, vat black 8, vat black 16, vat black 20, vat black 25, vat blue 8, vat blue 19, vat blue 43, vat green 1, phthalocyanines, perylene diimides, terrylene diimides, quaterrylene diimides, and mixtures thereof.

* * * * *